US007866749B2

(12) United States Patent
Costaglia et al.

(10) Patent No.: US 7,866,749 B2
(45) Date of Patent: Jan. 11, 2011

(54) ADJUSTMENT DEVICE FOR A RECLINING CHAIR

(75) Inventors: Massimo Costaglia, Santa Giustina in Colle (IT); Alessandro Slongo, Mogliano Veneto (IT)

(73) Assignee: L & P Property Management Company, South Gate, CA (US)

( * ) Notice: Subject to any disclaimer, the term of this patent is extended or adjusted under 35 U.S.C. 154(b) by 133 days.

(21) Appl. No.: 12/098,120

(22) Filed: Apr. 4, 2008

(65) Prior Publication Data

US 2009/0008979 A1 Jan. 8, 2009

(30) Foreign Application Priority Data

Apr. 6, 2007 (IT) ..... MI07A0719

(51) Int. Cl.
*A47C 1/024* (2006.01)
*A47C 1/032* (2006.01)

(52) U.S. Cl. ..... 297/300.5; 297/300.8; 297/301.7; 297/303.5

(58) Field of Classification Search ..... 297/300.5, 297/300.7, 300.8, 301.4, 301.6, 301.7, 302.4, 297/303.5
See application file for complete search history.

(56) References Cited

U.S. PATENT DOCUMENTS

| | | | |
|---|---|---|---|
| 4,348,898 | A | 9/1982 | Stan |
| 4,408,800 | A | 10/1983 | Knapp |
| 4,438,898 | A | 3/1984 | Knoblauch |
| 4,652,050 | A | 3/1987 | Stevens |
| 4,889,384 | A | 12/1989 | Sulzer |
| 5,029,940 | A | 7/1991 | Golynsky |
| 5,871,258 | A | 2/1999 | Battey |
| 5,997,087 | A | 12/1999 | Stumpf |
| 6,000,756 | A | 12/1999 | Hybarger |
| 6,010,189 | A | 1/2000 | Hybarger et al. |
| 6,027,169 | A | 2/2000 | Roslund, Jr. |
| 6,378,943 | B1 | 4/2002 | Beggs |
| 6,588,845 | B2 | 7/2003 | Wilkerson |
| 6,685,267 | B1 | 2/2004 | Johnson et al. |

(Continued)

FOREIGN PATENT DOCUMENTS

| | | | |
|---|---|---|---|
| EP | 0105955 | B1 | 2/1986 |

(Continued)

*Primary Examiner*—David Dunn
*Assistant Examiner*—Tania Abraham
(74) *Attorney, Agent, or Firm*—Shook, Hardy & Bacon LLP

(57) ABSTRACT

A tilting device for a reclining chair including a support base that can be affixed to at least one pedestal, a mounting body for the back of a seat which is articulated on said support base rotatably around a first axis essentially orthogonal to said pedestal, a mounting plate for the seat of said surface of said seat which has its front end and back end rotatably articulated around a respective hinge axis generally parallel to said first axis respectively to said support base and to said mounting body, elastic means of thrust acting along a direction generally orthogonal to said first axis and having a first end acting on said support base and a second end acting on said mounting body and blocking means of said mounting body in at least two different angles relative to said support base and acting in opposition to said elastic means of thrust, said mounting plate assuming two corresponding different angles.

12 Claims, 8 Drawing Sheets

U.S. PATENT DOCUMENTS

| | | | | |
|---|---|---|---|---|
| 6,779,847 | B2 | 3/2005 | Klein | |
| 6,871,909 | B2 | 3/2005 | Hobb | |
| 6,921,134 | B1 | 7/2005 | Hong | |
| 6,945,603 | B2 | 9/2005 | Elzenbeck | |
| 6,957,862 | B2 | 10/2005 | Chen | |
| 6,957,864 | B2 | 10/2005 | Chen | |
| 7,014,262 | B2 * | 3/2006 | Rossetto et al. | 297/300.8 |
| 7,040,711 | B2 | 5/2006 | DeKraker | |
| 7,080,884 | B2 * | 7/2006 | Daeschle et al. | 297/303.4 |
| 7,147,285 | B2 | 12/2006 | Lin | |
| 2001/0013569 | A1 | 8/2001 | Donati | |
| 2004/0140703 | A1 | 7/2004 | Bock | |
| 2004/0212235 | A1 | 10/2004 | Elzenbeck | |
| 2004/0245827 | A1 | 12/2004 | Bedford et al. | |
| 2006/0071522 | A1 | 4/2006 | Bedford et al. | |
| 2006/0163925 | A1 | 7/2006 | Bock | |
| 2006/0255636 | A1 | 11/2006 | Donati | |
| 2006/0290185 | A1 | 12/2006 | Moreschi | |
| 2007/0040432 | A1 | 2/2007 | Donati | |
| 2007/0040433 | A1 | 2/2007 | Huang | |

FOREIGN PATENT DOCUMENTS

| | | | |
|---|---|---|---|
| EP | 0568233 | B1 | 6/1996 |

* cited by examiner

ADJUSTMENT DEVICE FOR A RECLINING CHAIR

CROSS-REFERENCE TO RELATED APPLICATIONS

This application claims priority to prior-filed Italy application Serial No. MI2007A 000719, filed Apr. 6, 2007, incorporated by reference herein.

BACKGROUND OF THE INVENTION

The present invention relates to a tilting device for a reclining chair having a adjustable seat.

As used herein, the term "adjustable seat" indicates any seat of the type of a chair or armchair particularly for an office or a writing desk, comprising a seat surface and a back associated by relative mounting bodies, to a common support base in turn connected to a pedestal (e.g., for height adjustment) or ground mounting post.

Adjustable seats are known in which the back or seat surface, or their respective mounting bodies, are tiltable relative to the support base independently or dependently of each other, for example using tilting devices comprising lever mechanisms.

SUMMARY OF THE INVENTION

In one aspect, an embodiment summary of the present invention is to provide a tilt device for adjustable seats that is easy for users to use and that allow modifications that are simple and without forcing the angle of the back and the seat surface.

A tilting device for a reclining chair includes an adjustable seat. In one embodiment, the adjustable seat comprises a support base that can be associated with at least one pedestal, a mounting body for the seat back which is rotatably articulated on the support base around a first axis essentially orthogonal to the pedestal, a mounting plate for the seat surface which has its front end and back end articulate rotatably around a respective hinge axis generally parallel to the first axis to the support base and mounting body, respectively, elastic means of thrust acting along one direction generally orthogonal to the first axis and having a first end acting on the support base and a second end acting on the mounting body and the blocking means of the mounting body in at least two different angles relative to the support base and acting in opposition to the elastic means of thrust, the mounting plate assuming two corresponding different angles.

BRIEF DESCRIPTION OF THE DRAWING

Further characteristics and advantages of the invention will be found in the specification of one or more embodiments of the device according to the invention, illustrated by way of non-limiting examples of the attached drawings, in which.

DETAILED DESCRIPTION OF THE INVENTION

Figure 1:
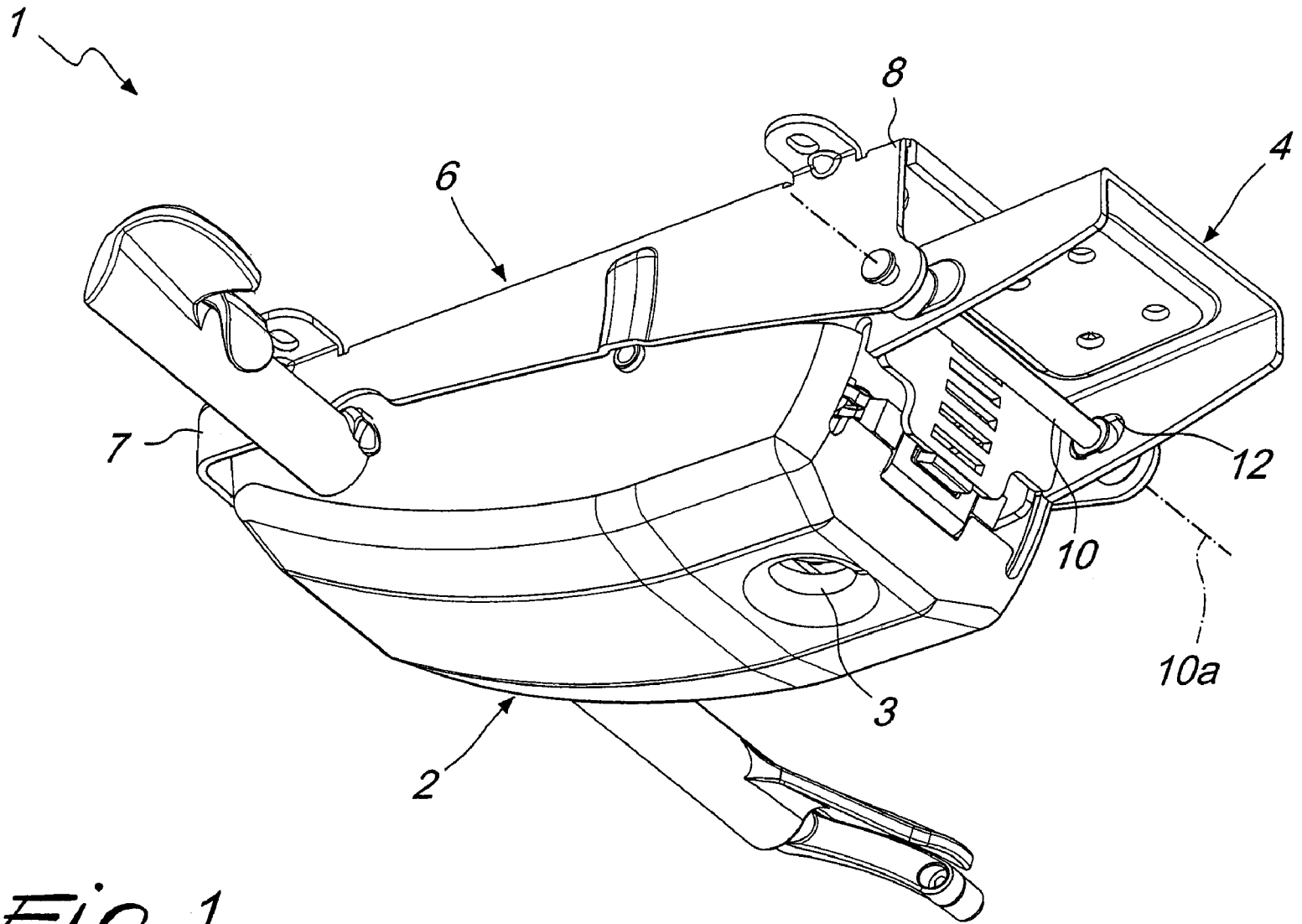
FIG. 1 is a perspective view of the device according to the invention.
Figure 2:
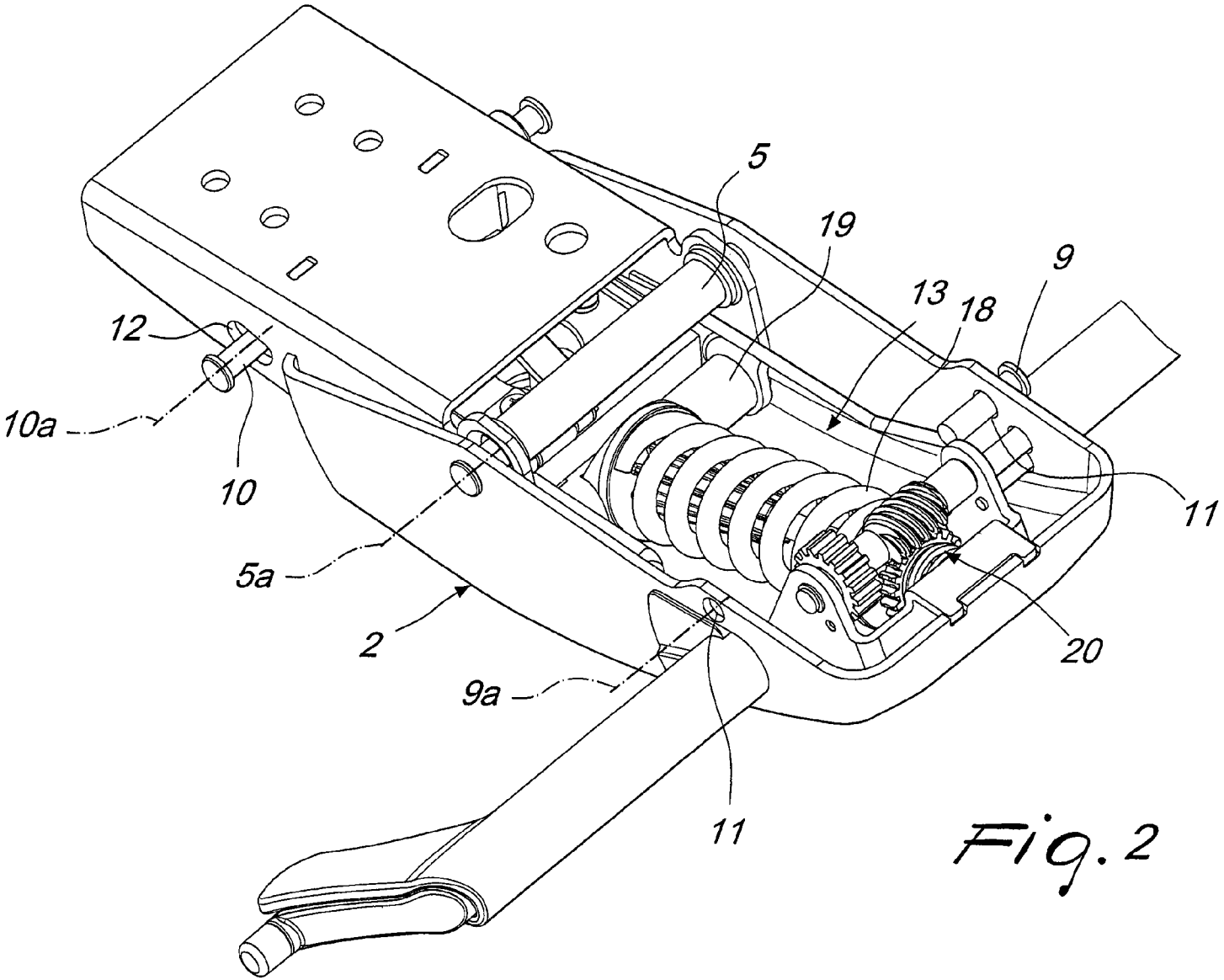
FIG. 2 is a perspective view of the device according to the invention without the mounting plate for the seat surface.

With reference to the Figures, a tilting device for a reclining chair is indicated generally by reference numeral 1.

In one embodiment, device 1 has a support base 2 provided with a connection seat 3 with at least one pedestal 30. A mounting body 4 for the seat back is rotatably articulated on the support base 2 around a first axis 5*a* which is defined by a first pivot 5 which has its opposite ends fastened to the two sides of the support base 2. The first axis 5*a*, that is the first pivot 5 is, in the use configuration of the seat, parallel to the round and orthogonal to the pedestal 30.

Device 1 also has a mounting plate 6 to the lower side of the seat surface which has a front end 7 and back end 8. The front end 7 and the back end 8 are rotatably articulated around a respective hinge axis, 9*a* and 10*a*, essentially parallel to the first axis 5*a* respectively to the support base 2 and the mounting body 4. The hinge axis 9*a* of the front end 7 of the mounting plate 6 is defined by a pair of second pivots 9 solidly connected to the mounting plate 6 and housed in corresponding seats 11 machined into the sides of the support base 2. The hinge axis 10*a* of the back end 8 of the mounting plate 6 is defined by a third pivot 10 which is movably supported in corresponding buttonholes 12 machined in the sides of the mounting body 4.

Figure 4:
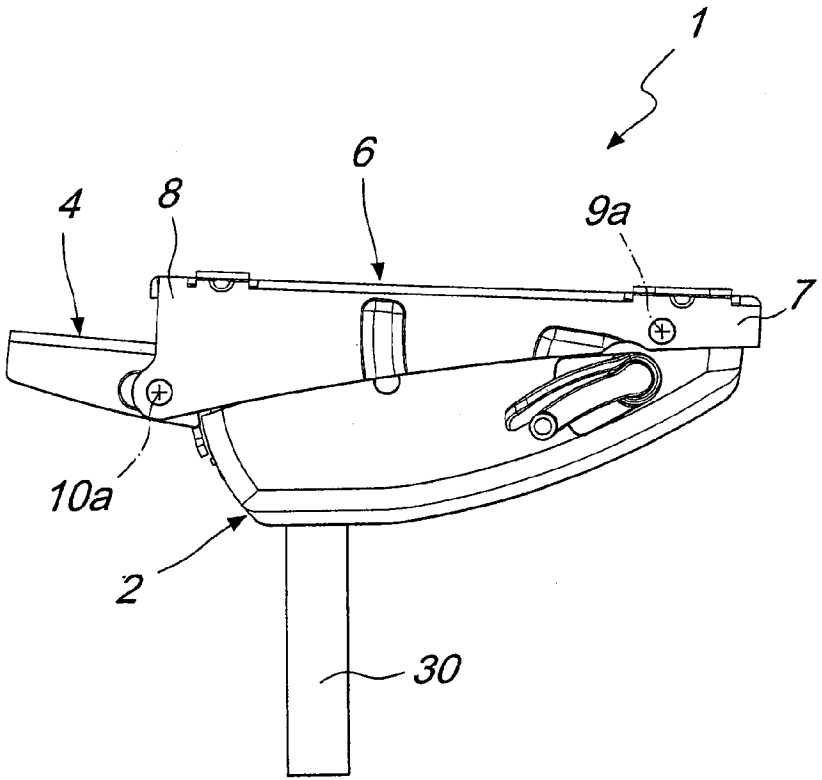
FIG. 4 is a side and schematic view of the device according to the invention with the mounting body of the back and the mounting plate of the seat surface in second relative angle.

Device 1 further has an elastic means of thrust 13 acting along one direction essentially orthogonal and obliquely to the first axis 5*a* and having a first end acting on the support base 2 and a second end acting on the mounting body 4. The mounting body 4 of the back and, therefore, the mounting plate 6 of the seat surface articulated to it, assume at least two different angles relative to the support base 2: a first position, in which the mounting body 4 and the mounting plate 6 are essentially parallel to the ground (FIGS. 3, 5 and 8), and a second position, in which the mounting body 4 and the mounting plate 6 are inclined forward and toward the ground (FIGS. 4, 6 and 9).

Device 1 has a blocking means 14, acting contrary to the elastic means of thrust 13, of the mounting body 4 in the two different angles that can be operated by an actuator 15 which can be operated by a user. The elastic means of thrust 13 comprise a telescopic track consisting of a first tubular element 16 within which is slidingly guided a second tubular element comprising a rod 17, between the first tubular element 16 and the rod 17 acting on a compression spring 18. the first tubular element 16 has the end opposite to the one connected with the rod 17 hinged around a fourth pivot 19 fastened to the mounting body 4 and generally parallel and staggered relative to the first pivot 5. The second end of the elastic means of thrust 13 comprises the head 16*a* of the first tubular element 16 articulated around the fourth pivot 19. The rod 17 has one end inserted slidingly inside the first tubular element 16 and the opposite end connected to the support base 2 through a device 20 adjusting the compression state of the spring 18.

The blocking means 14 has a stop surface 21 of the second end of the elastic means of thrust 13, that is, of the head 16*a* of the first tubular element 16, which is defined overhanging from the bottom of the support base 2.

On the stop surface 21 a stop insert 22 is guided slidingly for the second end of the elastic means of thrust, that is, for the head 16*a* of the first tubular element 16.

The stop insert 22 is movable in sliding along a direction generally orthogonal to the action direction of the elastic means of thrust 13 between an extended configuration and a retracted configuration.

In the extended configuration, the stop insert 22 is interposed between the stop surface 21 and the head 16*a* of the first tubular element 16, the mounting body 4 and, therefore, the mounting plate 6, being in the first angle relative to the support base 2.

In the retracted configuration, the stop insert 22 is retracted and the head 16*a* of the first tubular element 16 rests on the stop surface 21, the mounting body 4 and, therefore, the mounting plate 6, being in the second angle relative to the support base 2.

The stop surface 21 in one configuration, is defined integral with the support base 2 close to the seat 3.

The stop surface 21 extends along a transverse plane in the action direction of the elastic means of thrust 13 and defines a sliding plane on which the stop insert 22 is guided in rectilinear motion alternative between the extended configuration and the retraced configuration.

Figure 5:
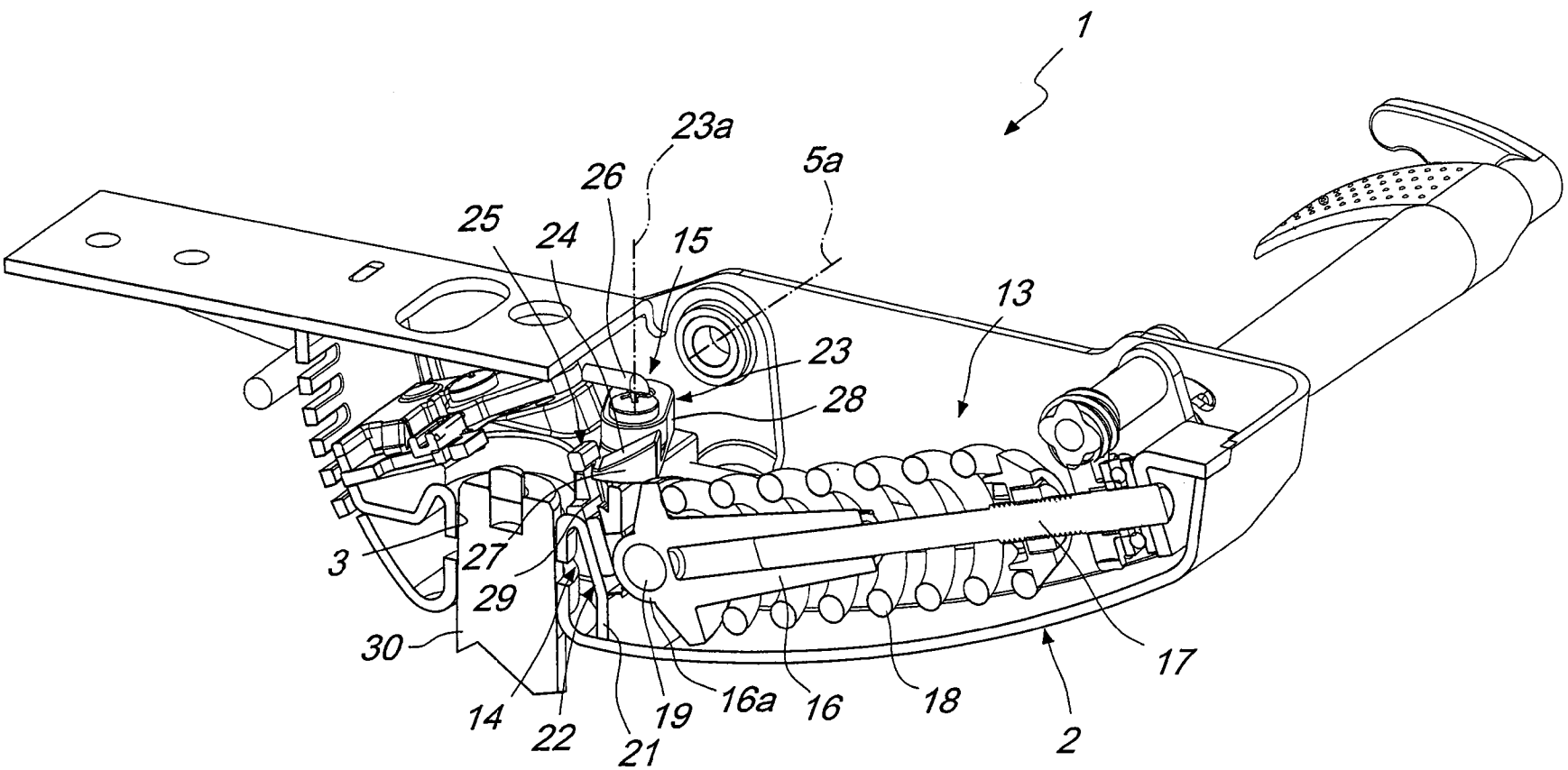
FIG. 5 is a prospective view and partial sectional view of the device according to the invention in the first position of FIG. 3.
Figure 6:
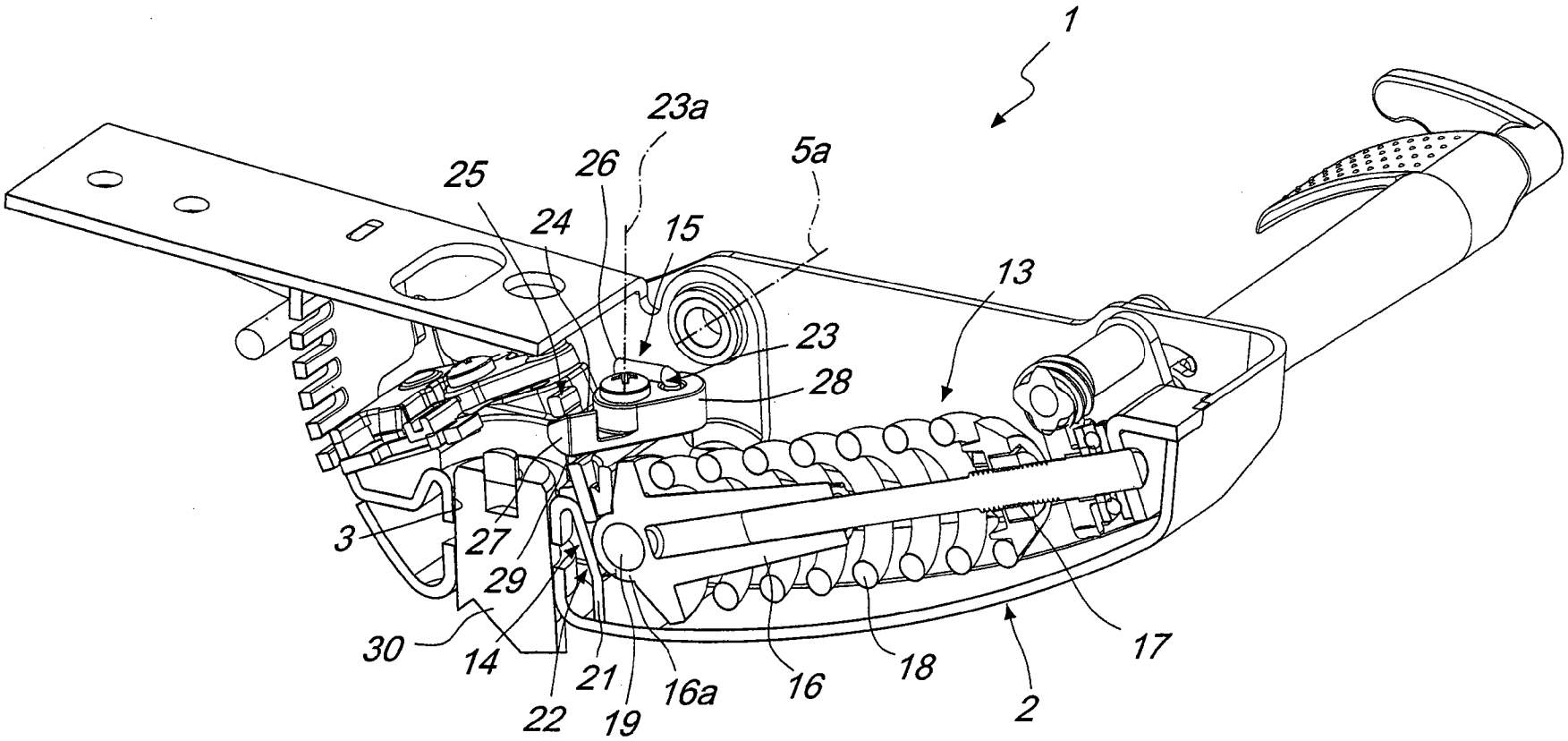
FIG. 6 is a prospective view and partial sectional view of the device according to the invention in the second position of FIG. 4.

In one embodiment represented in FIGS. 5 and 6, the actuator 15 includes a cam body 23, which is movably associated with the support base 2 and which is provided with a track profile 24 on which a follower 25 slides associated to the stop insert 22, and a control rod 26 of the cam body 23 which can be operated from the outside by a user. The track profile 24 defines the motion of the stop insert 22 between the extended configuration and the retracted configuration.

In the embodiment represented in the attached FIGS. 5 and 6, the cam body 23 is pivoted to the support base 2 rotatably around an axis 23*a* essentially parallel to the pedestal 30 and has a first arm 27 on which is machined the track profile 24 and a second arm 28, opposed to the first arm, to which it is constrained by one end of control rod 26. The opposite end of control rod 26 is provided with a grip knob for the user not shown in detail. Track profile 24 provides a ramp inclined relative to an essentially horizontal plane.

The follower 25 has a window 29 machined in the stop insert 22 and in which is movably inserted in the first arm 27 on which is defined the track profile 24. The upper potion of window 29 has a runner slidingly supported on the ramp machined on the first arm 27.

Figure 7:
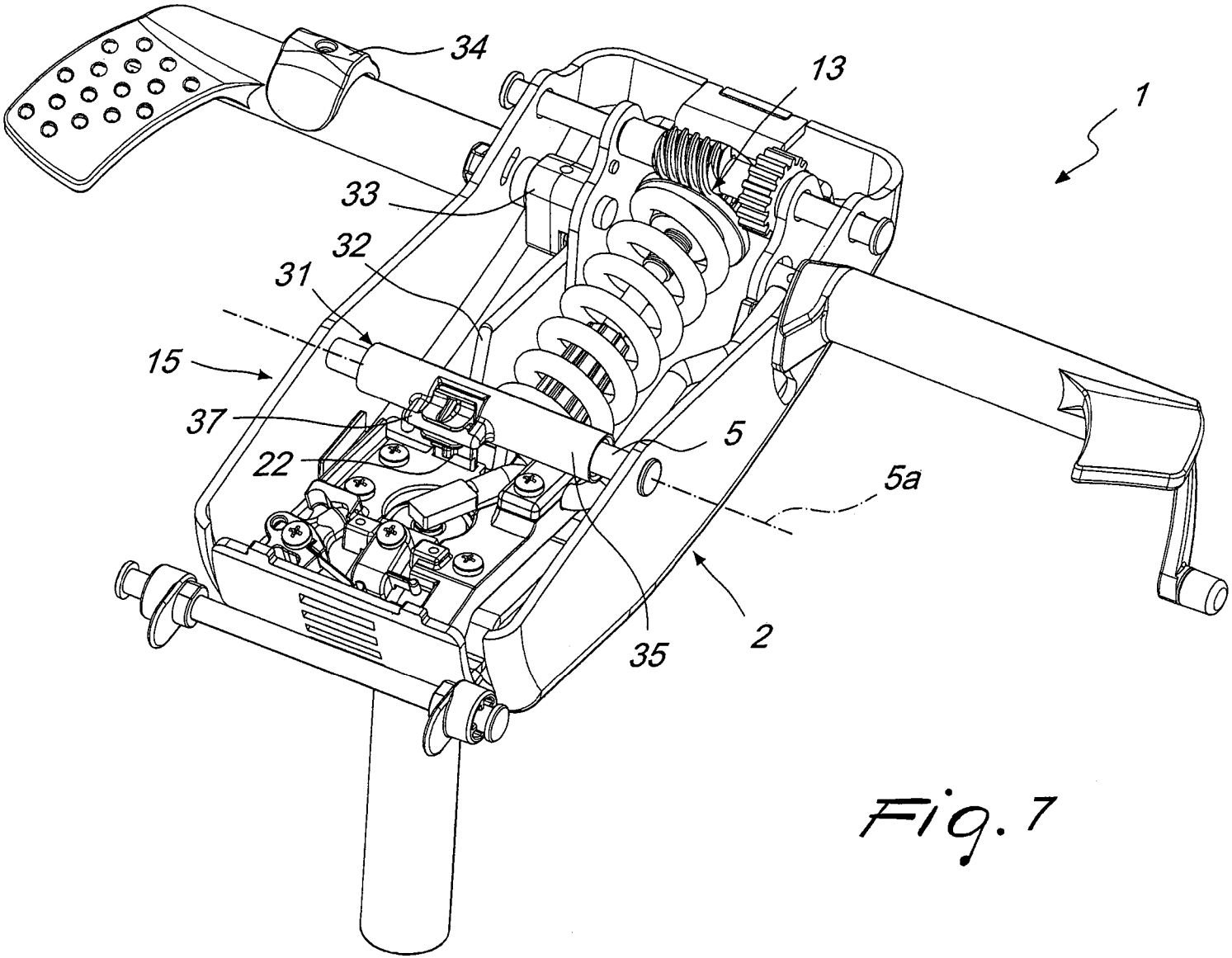
FIG. 7 is a prospective view and partial sectional view of an alternate embodiment of the device according to the invention.
Figure 8:
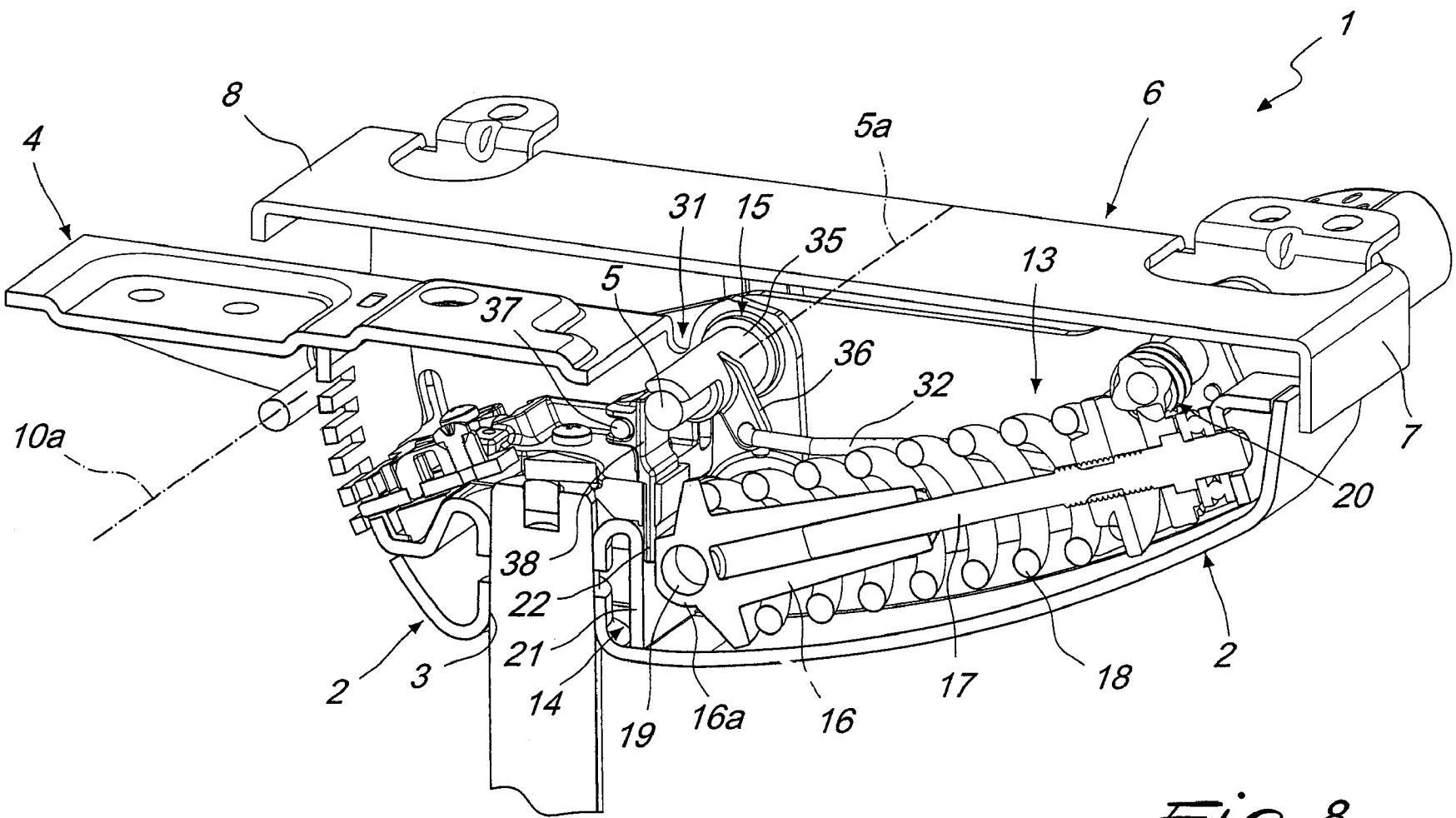
FIG. 8 is a prospective view and partial sectional view of the device of FIG. 7 with the mounting body of the back and the mounting plate of the seat surface in the first angle.
Figure 9:
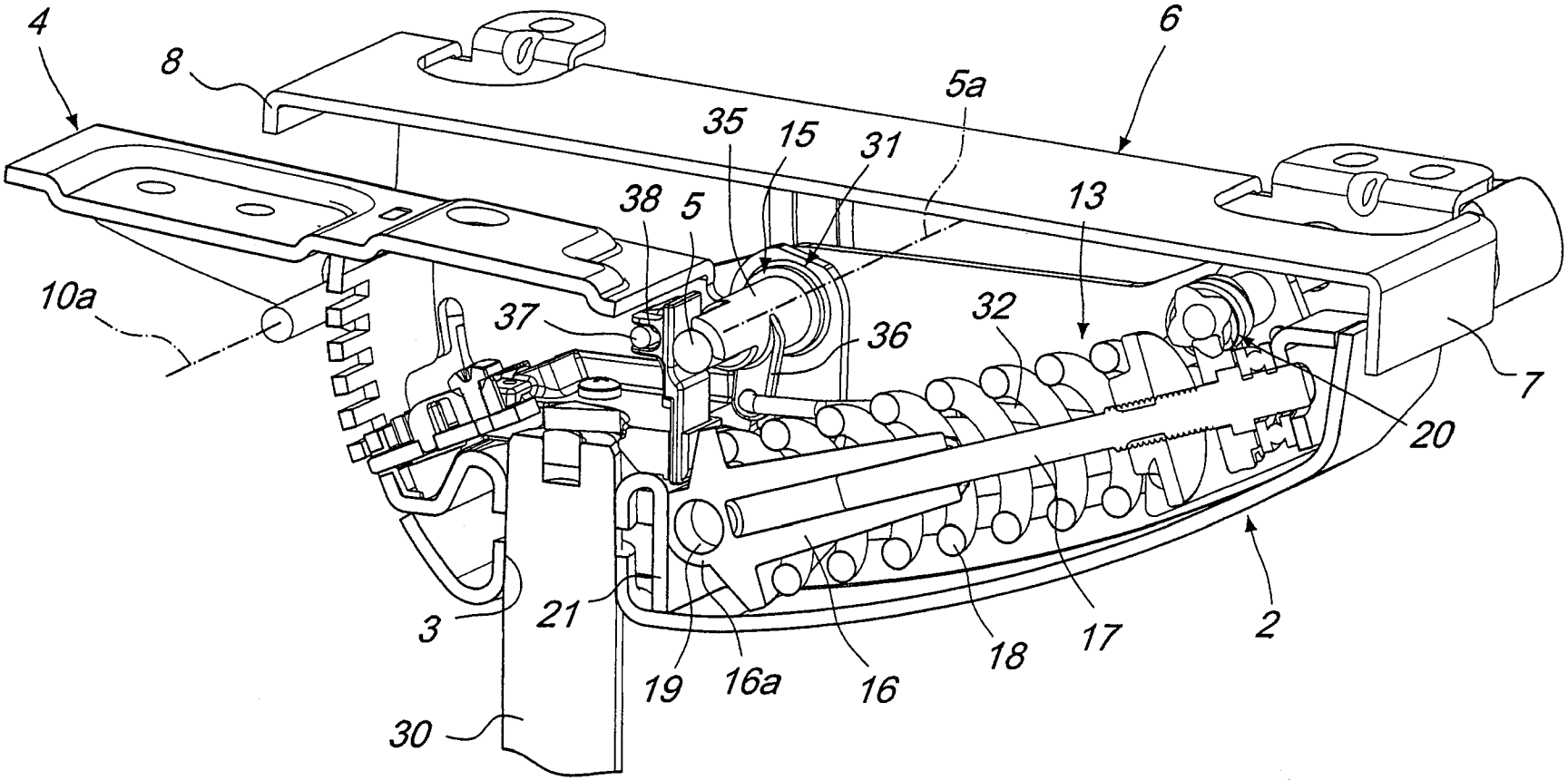
FIG. 9 is a prospective view and partial sectional view of FIG. 7 with the mounting body of the back and the mounting plate of the seat surface in the second angle.

In another embodiment represented in FIGS. 7-9, the actuator 15 includes a lever 31 rotatably articulated around the first pivot 5 and connected at the end of a rod 32 whose opposite end is associated with a rotating element 33 controlled by a slider 34. Lever 31 engages with the end upper of the stop insert 22 from the extended configuration to the retracted one and vice-versa. In particular, lever 31 includes a cylindrical body 35 rotatably articulated around the first pivot 5 and from which there extend, from opposite places relative to the first pivot 5, a first arm 36 connected to the end of the rod 32 and a second arm 37 which engages with the upper end of the stop insert 22. The second arm 37 has a pivot parallel to the first pivot 5 and which is inserted in a corresponding seat 38 machined from the upper end of the stop insert 22.

FIGS. 1-9, the back and the seat surface are not represented for sake of clarity in describing the function of certain embodiments of the present invention.

Figure 3:
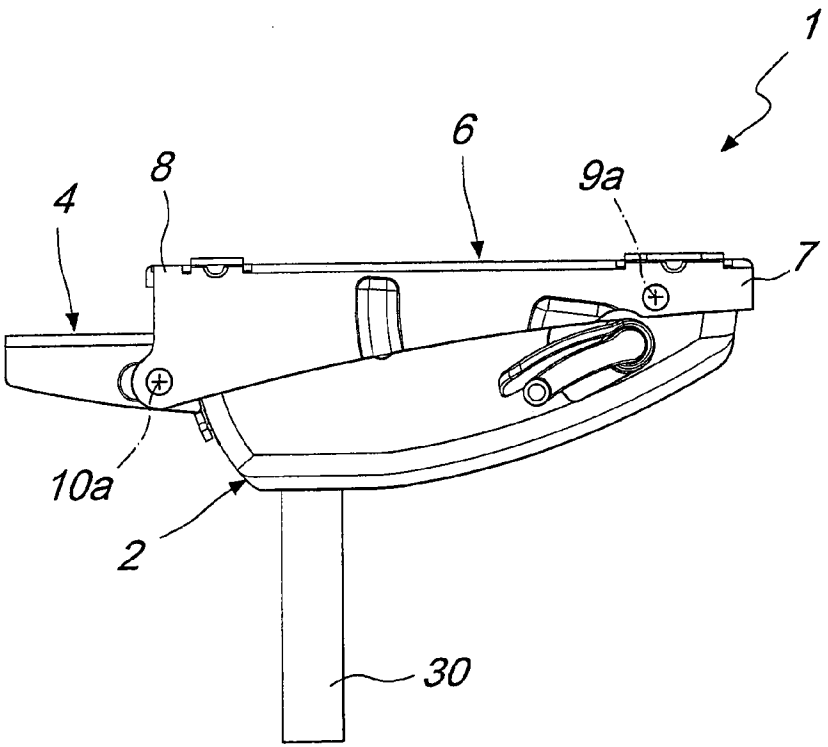
FIG. 3 is a side and schematic view of the device according to the invention with the mounting body of the back and the mounting plate of the seat surface in a first relative angle.

FIGS. 3 and 5 represent device 1 in normal use configuration with the mounting body 4 of the back of the mounting plate 6 of the seat surface in the first angle relative to the support base 2 in which both are essentially parallel to the ground. In this first position, the stop insert 22 is in extended configuration and is interposed between the stop surface 21 and the head 16*a* of the first tubular element 16. The second end of the elastic means of thrust 13 acts on the stop insert 22.

With particular reference to one embodiment represented in FIGS. 5 and 6, exerting a traction action on the control rod 26 one generates the rotation of the cam body 23 around the axis 23*a*. As a result of this rotation (clockwise in the views provided) the follower 25 is required to slide upward on the ramp of the sliding profile 24. The sliding of the follower 25 drags the stop insert 22 upwards, removing it from the interference area with the head 16*a* of the first tubular element 16.

As a result of the thrust action of the spring 18, the first tubular element 16 is thrust at a distance relative to the rod 17 until its head 16*a* no longer rests on the stop surface 21. The first tubular element 16, by means of the pivot 19, imparts to the back mounting body 4 a rotation around the first pivot 5. The mounting body 4 and, therefore, the mounting plate 6 articulated to it revolve in the second angle in which they are both tilted forward and toward the ground (FIGS. 4 and 6).

With reference to another embodiment represented in FIGS. 7-9, acting on the slider 34, rotation of the rotating element 33 is generated such as to exert a traction action on the rod 32. The rod 32 makes rotate the lever 31 (counterclockwise in the views provided) whose second arm 37 lifts the stop insert 22 which thus slides from the extended configuration to the retracted configuration.

As a result of the thrusting action of the spring 18, the first tubular element 16 is thrust at a distance relative to the rod 17 until its head 16*a* rests on the stop surface 21. The first tubular element 16, by means of the pivot 19, imparts to the mounting body 4 of the back a rotation around the first pivot 5. The mounting body 4 and, therefore, the mounting plate 6 articulated to it rotate in the second angle in which both are titled forward and toward the ground (see FIG. 9).

Various embodiments of the tilting device for a reclining chair are subject to many modifications and variants, all of which fall within the scope of the inventive concept. Also all of the details can be replaced by other technically equivalent elements. In practice, the materials used, as well as the dimensions and contingent shapes can be any ones according to needs and the state of the art.

What is claimed is:

1. A tilting device for a reclining chair possessing an adjustable seat, comprising: a support base associable to at least one pedestal, a mounting body for a seat back which is rotatably articulated to said support base around a first axis essentially orthogonal to said pedestal, a mounting plate for the seat surface of said seat which has a front end and a back end rotatably articulated around a respective hinge axis essentially parallel to said first axis, to said support base and to said mounting body, respectively, an elastic means of thrust acting along an essentially orthogonal direction with respect to said first axis, said elastic means of thrust having a first end acting on said support base and a second end acting on said mounting body, and blocking means for selectively positioning said mounting body in at least two different neutral positions, each neutral position providing said mounting body in a different angle relative to said support base, said blocking means acting contrary to said elastic means of thrust, said mounting plate assuming two corresponding different angles.

2. A device according to claim 1, characterized in that it comprises actuator means of said blocking means.

3. A device according to claim 2, characterized in that said blocking means comprise a stop surface for said second end of the elastic means of thrust which is defined in overhang from said support base and on which is slidingly guided a stop insert which is movable between an extended configuration, in which said stop insert is interposed between said stop surface and said second end, said mounting body being in a first angle relative to said support base, and a retracted configuration, in which said second end rests on said stop surface, said mounting body being in a second angle relative to said support base.

4. A device according to claim 3, characterized in that said stop surface is defined as being integral with said support base.

5. A device according to claim 3, characterized in that said stop surface extends on a transverse level to the action direction of said elastic means of thrust, said stop insert being slidingly guided in alternating rectilinear motion between said extended configuration and said retracted configuration on said level.

6. A device according to claim 3, characterized in that said actuator means comprises a cam body that is movably associated to said support base and which is provided with a track profile on which slides an associated follower to said stop insert and a control rod of said cam body which can be operated from the outside by a user, said track profile defining the movement of said stop insert between said extended configuration and said retracted configuration.

7. A device according to claim 6, characterized in that said cam body is pivoted to said support base rotatably around an axis essentially parallel to said pedestal, said track profile comprising a ramp inclined relative to an essentially horizontal level.

8. A device according to claim 7, characterized in that said follower comprises a window defined in said stop insert and into which is movably inserted said cam body, the upper portion of said window defining a runner in sliding support on said ramp.

9. A device according to claim 1, characterized in that said elastic means of thrust comprise a telescopic track, which includes a first tubular element which has an end hinged around a pivot fastened to said mounting body and essentially parallel to said first axis and the opposite end slidingly connected to a second tubular element in turn connected to said support base, and at least one elastic element acting between said first tubular element and said second tubular element, said second end of the elastic means of thrust being defined by said end hinged of said first tubular element.

10. A device according to claim 1, characterized in that the hinge axis of the back end of said mounting plate is defined by at least one pivot movable along a corresponding buttonhole defined in said mounting body of the back.

11. A tilting device for a reclining chair possessing an adjustable seat, comprising:

a support base associable to at least one pedestal;

a mounting body for a seat back which is rotatably articulated to said support base around a first axis essentially orthogonal to said pedestal;

a mounting plate for the seat surface of said seat which has a front end and a back end rotatably articulated around a respective hinge axis essentially parallel to said first axis, to said support base and to said mounting body, respectively;

an elastic means of thrust acting along an essentially orthogonal direction with respect to said first axis, said elastic means of thrust having a first end acting on said support base and a second end acting on said mounting body; and blocking means for selectively positioning said mounting body in at least two different neutral positions, each neutral position providing said mounting body in a different angle relative to said support base, said blocking means acting contrary to said elastic means of thrust, said mounting plate assuming two corresponding different angles, wherein said elastic means of thrust comprise a telescopic track, which includes a first tubular element which has an end hinged around a pivot fastened to said mounting body and essentially parallel to said first axis and the opposite end slidingly connected to a second tubular element in turn connected to said support base, and at least one elastic element acting between said first tubular element and said second tubular element, said second end of the elastic means of thrust being defined by said end hinged of said first tubular element.

12. A tilting device for a reclining chair possessing an adjustable seat, comprising:

a support base associable to at least one pedestal;

a mounting body for a seat back which is rotatably articulated to said support base around a first axis essentially orthogonal to said pedestal;

a mounting plate for the seat surface of said seat which has a front end and a back end rotatably articulated around a respective hinge axis essentially parallel to said first axis, to said support base and to said mounting body, respectively, and wherein the hinge axis of the back end of said mounting plate is defined by at least one pivot movable along a corresponding buttonhole defined in said mounting body of the back end;

an elastic means of thrust acting along an essentially orthogonal direction with respect to said first axis, said elastic means of thrust having a first end acting on said support base and a second end acting on said mounting body; and blocking means for selectively positioning said mounting body in at least two different neutral positions, each neutral position providing said mounting body in a different angle relative to said support base, said blocking means acting contrary to said elastic means of thrust, said mounting plate assuming two corresponding different angles.

* * * * *